US007277024B2

(12) United States Patent
Chen

(10) Patent No.: US 7,277,024 B2
(45) Date of Patent: Oct. 2, 2007

(54) REMOTE LIGHTING CONTROL DEVICE FOR LAMP STRING

(75) Inventor: Wen Tarng Chen, Hsin-Chu (TW)

(73) Assignee: Willis Electric Co., Ltd., Hsin-Chu (TW)

( * ) Notice: Subject to any disclaimer, the term of this patent is extended or adjusted under 35 U.S.C. 154(b) by 55 days.

(21) Appl. No.: 11/217,600

(22) Filed: Sep. 2, 2005

(65) Prior Publication Data

US 2006/0104059 A1 May 18, 2006

(30) Foreign Application Priority Data

Nov. 15, 2004 (CN) ..... 2004 2 0057308

(51) Int. Cl.
*H01Q 21/12* (2006.01)
*F21V 33/00* (2006.01)

(52) U.S. Cl. ..... 340/815.55; 340/815.56; 340/815.57; 340/815.65; 362/234; 362/233; 362/235

(58) Field of Classification Search ..... 340/815.55–815.7, 815.65, 815.66, 815.67, 340/815.73, 815.74, 815.75, 815.4, 825; 362/234, 233, 235, 84, 85, 3; 315/312, 316, 315/292

See application file for complete search history.

(56) References Cited

U.S. PATENT DOCUMENTS

| | | | | |
|---|---|---|---|---|
| 6,338,105 | B1 * | 1/2002 | Niizuma et al. | 710/72 |
| 2002/0036720 | A1 * | 3/2002 | Umeda | 348/734 |
| 2002/0145043 | A1 * | 10/2002 | Challa et al. | 235/462.01 |
| 2002/0163440 | A1 * | 11/2002 | Tsui | 340/825.69 |
| 2004/0160199 | A1 * | 8/2004 | Morgan et al. | 315/312 |
| 2005/0111231 | A1 * | 5/2005 | Crodian et al. | 362/545 |

* cited by examiner

*Primary Examiner*—Tuyet Vo
(74) *Attorney, Agent, or Firm*—Rosenberg, Klein & Lee

(57) ABSTRACT

A remote controlling device includes a micro-controller; a transmitter coupled to the micro-controller to selectively transmit a control signal that controls the lighting of a lamp string, the transmitter comprising an encoder for coding the control signal; a preset lighting mode memory coupled to the micro-controller to store preset lighting modes; and lighting control program memory coupled to the micro-controller to store lighting control programs, each comprised of at least one lighting mode selected from the preset lighting mode memory. A user may operate a plurality of selection switches to select the preset lighting modes and the lighting control programs from the memories. Actuation of a transmission button allows for transmission of the control signal that carries the lighting control program selected from the lighting control program memory toward a receiver of the lamp control module of the lamp string in a wireless manner for controlling the lighting of the lamp string.

7 Claims, 8 Drawing Sheets

REMOTE LIGHTING CONTROL DEVICE FOR LAMP STRING

FIELD OF THE INVENTION

The present invention relates generally to the field of lighting control for a lamp string, such as a Christmas lamp string, and in particular to a remote controlling device for the lamp string.

BACKGROUND OF THE INVENTION

Lamp strings have been widely used in festival and holidays for decoration and celebration purposes. Conventional lamp strings are comprised of a pair of electrical wires and lamp strings connected to the wires in series or parallel. Each lamp string comprises a plurality of lamp bulbs. To effect flashing, a primary bulb is connected to each lamp string and the primary bulb comprises a bimetal switch, which opens and closes the circuit of the bulb due to high temperature caused by the current flow through the bimetal switch. This causes flashing of the lamps.

The flashing of such a conventional arrangement is fixed. In other words, variation of the lighting operation of the lamps is not available for such an arrangement. Further, the electrical characteristics of each primary bulb are unique, which makes the plurality of lamp strings lit in different timing. No precise control of the lighting timing can be realized.

Another conventional technique employs a controller to control the lighting operation of the plurality of lamp strings. The controller reduces a sequential control signal that controls the lighting of the lamp strings individually. In addition, the controller is provided with different lighting schemes, which can be selected by a user through a user-operating knob or switch. Thus, the lighting operations of the plurality of lamp strings can be selectively different from each other and variation of the lighting of the lamp strings can be realized.

The use of controller effectively improves the control of lighting of the lamp strings. However, it is manually operated. The user must manually operate the knob to switch between different lighting schemes. In addition, although several different lighting schemes are provided in advance, addition or modification of these preset lighting schemes cannot be realized through the conventional technique.

Thus, the present invention is aimed to provide a control technique, which provides, for lighting lamp strings, flexibility in variation of the lighting schemes and modes without manual switching operation.

SUMMARY OF THE INVENTION

An objective of the present invention is to provide a remote controlling device that transmits in a wireless manner a lighting scheme composed of preset or user-selected lighting modes to a lamp control module to control lighting of lamp strings.

Another objective of the present invention is to provide a user-programmable and user-definable lamp string control device, wherein a user interface provided in the control device allows a user to operate, program, and set a lighting scheme for the lamp string and to control the lighting of the lamp string in a wireless manner.

A further objective of the present invention is to provide a lamp string control device that is flexible in programming and is capable of variation of lighting schemes, wherein the user is allowed to freely select lighting setting, and defining lamp groups, timing, and lighting modes, which are combined together as desired lighting scheme that is transmitted to a remote lamp control module in a wireless manner to effect ready control of lighting of lamp strings.

To achieve the above objectives, in accordance with the present invention, a remote controlling device comprises a micro-controller; a transmitter coupled to the micro-controller to selectively transmit a control signal that controls the lighting of a lamp string, the transmitter comprising an encoder for coding the control signal; a preset lighting mode memory coupled to the micro-controller to store preset lighting modes; and lighting control program memory coupled to the micro-controller to store lighting control programs, each comprised of at least one lighting mode selected from the preset lighting mode memory. A user may operate a plurality of selection switches to select the preset lighting modes and the lighting control programs from the memories. Actuation of a transmission button allows for transmission of the control signal that carries the lighting control program selected from the lighting control program memory toward a receiver of the lamp control module of the lamp string in a wireless manner for controlling the lighting of the lamp string.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
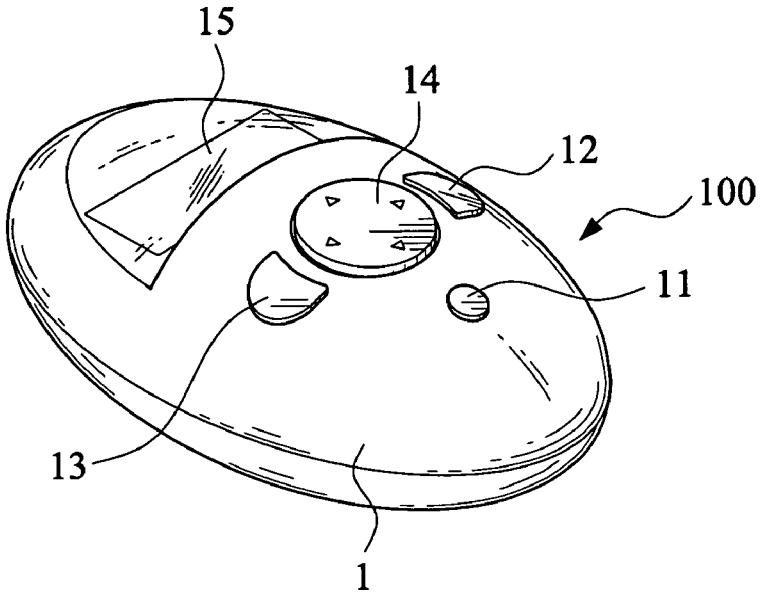
FIG. 1 is a perspective view showing a remote controlling device constructed in accordance with the present invention.
Figure 2:
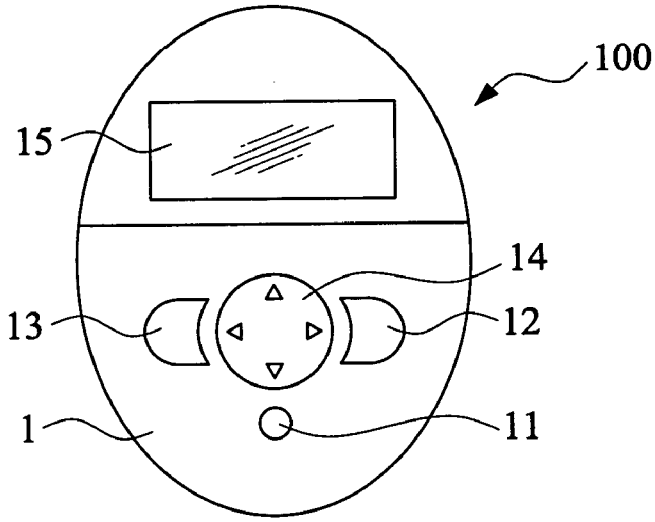
FIG. 2 is a top view of the remote controlling device of the present invention.

With reference to the drawings and in particular to FIGS. 1 and 2, a remote controlling device constructed in accordance with the present invention, generally designated with reference numeral 100, is selectively coupled, in a wireless manner, to a lamp string 4 composed of a number of individual lamps divided into groups that can be lit independently in a programmable manner in accordance with control signals issued by the remote controlling device 100. The remote controlling device 100 comprises a casing 1 on which a power switch 11, a transmission button 12, a cancellation button 13, and a selection pad 14 are mounted. The transmission button 12 serves as a manual control for selective transmission of the control signals from the remote controlling device 100 to the lamp string 4. The selection pad 14 comprises four direction switches, namely the upward switch 141, the downward switch 142, the leftward switch 143 and the rightward switch 144, which allows a user to move a cursor on a display screen to select items on the display screen, and an "enter" or actuation switch 145, which is for example actuated by depressing a central zone of the selection pad 14 to allow the user to enter the selection made by means of the direction switches 141, 142, 143, and 144. The cancellation button 13 serves to cancel the selection done with the selection pad 14. In the embodiment illustrated, the direction switches 141, 142, 143, and 144 are integrated with and arranged around the actuation switch 145.

A display 15, which comprises a display screen on which the selection pad 141 operates to control the movement of the selection cursor, is mounted on the casing 1 for showing menus that list control/operation items to be selected by the user with the selection pad 14 and the cancellation button 13. This will be further discussed later. An example of the display 15 is a liquid crystal display (LCD).

Figure 3:
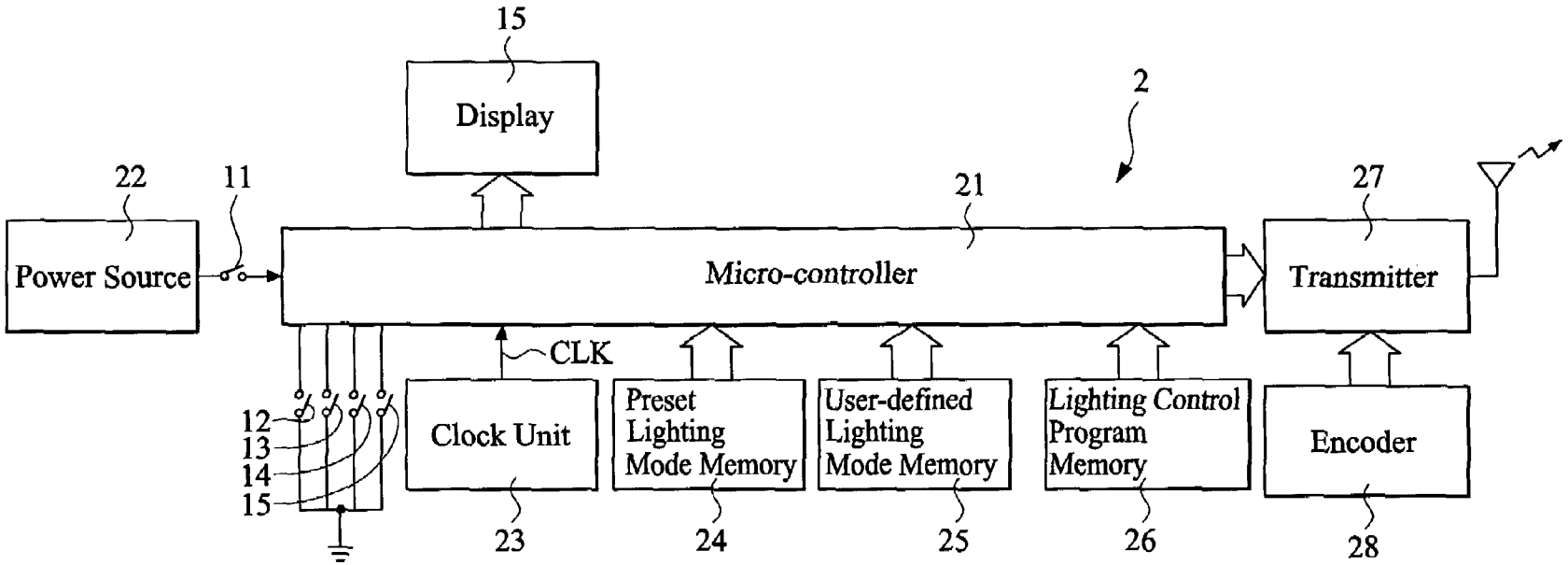
FIG. 3 is a functional block diagram of a control circuit of the remote controlling device of the present invention.

Also referring to FIG. 3, a block diagram of a control circuit 2 of the remote controlling device 100 in accordance with the present invention is shown. The control circuit comprises a micro-controller 21, which controls the operation of the remote controlling device 100. A power source 22, such as a battery set, for example a rechargeable cell, is connected via (and thus controlled by) the power switch 11 to the micro-controller 21, to supply working power to the remote controlling device 100. By actuating/de-actuating the power switch 11, power is selectively supplied from the power source 22 to the micro-controller 21.

The control circuit 2 comprises a clock unit 23, which is coupled to the micro-controller 21 for providing a clock signal CLK to the micro-controller 21. A number of storage memories, including a preset lighting mode memory 24 that stores a number of preset lighting modes, a user-defined lighting mode memory 25 that stores a number of user-defined lighting modes, and a lighting control program memory 26 that stores a number of lighting control programs, are coupled to the micro-controller 21 and are accessible by the user through the switch pad 14 and the display 15. The lighting control programs are selectively composed of a combination of several lighting modes selected from the preset lighting mode memory 24 and the user-defined lighting mode memory 25.

The control circuit 2 also comprises a transmitter 27 that receives the control signals from the micro-controller 21 and selectively transmits the control signals upon actuation of the transmission button 12. The transmitter 27 comprises an encoder 28 that converts the control signal into a predefined format or coding.

Figure 4:
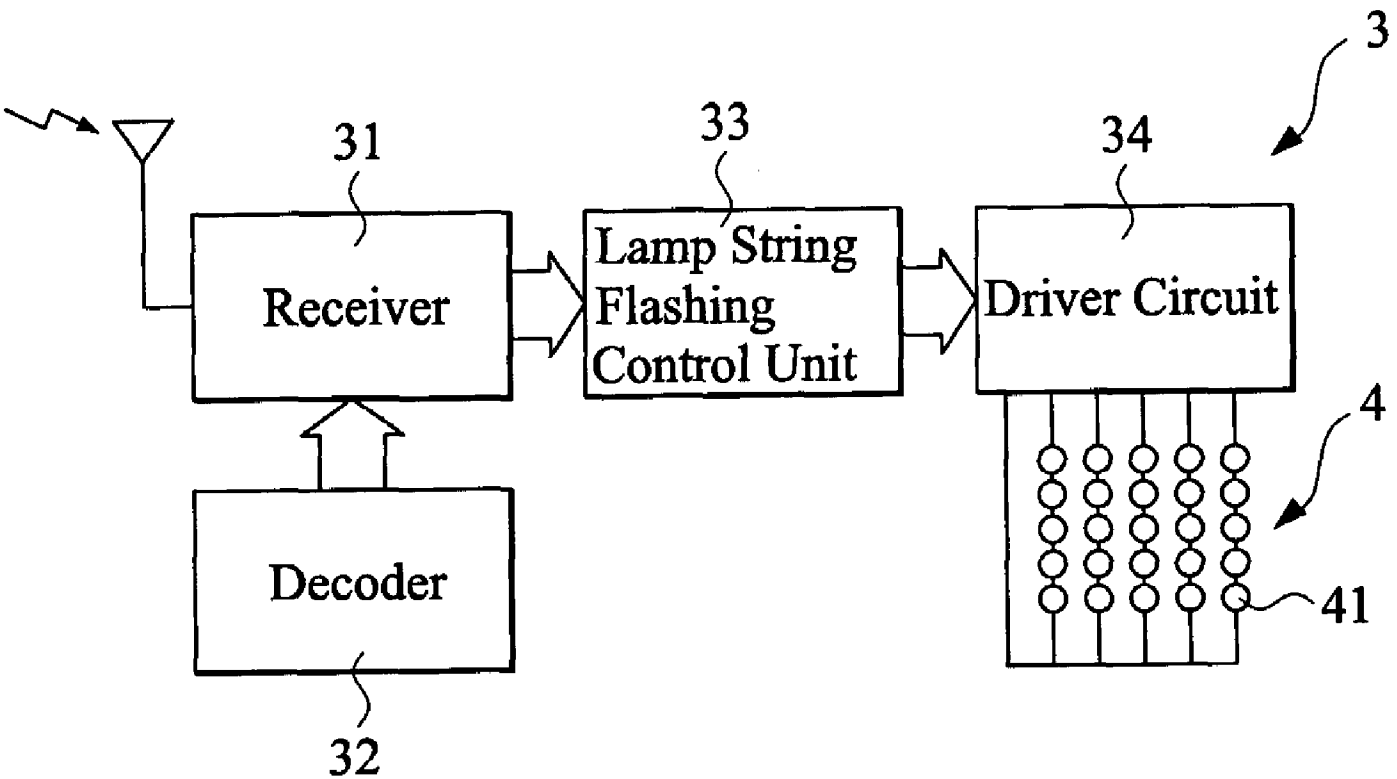
FIG. 4 is a functional block diagram of a lamp control module in accordance with the present invention.

Also referring to FIG. 4, in the embodiment illustrated, the control signal is transmitted from the transmitter 1 in a wireless manner through an antenna (not labeled). The transmitted control signal is received by a lamp control module 3 that is coupled to the lamp string 4. The lamp control module 3 comprises a receiver 31 that receives the transmitted control signal through an antenna. The received signal is decoded by a decoder 32 and then applied to a lamp string flashing control unit 33 to drive a driver circuit 34 coupled to the control unit 33. The lamp string 4 that is composed of the groups of lamps 41 is electrically connected to and thus driven by the driver circuit 34. The control unit 33 receives the decoded signal and, based on the decoded signal, control the driver 34 to light the lamps 41, such as lighting on/off the lamps 41, causing chasing, fading, flashing of the lamps 41.

An example of the wireless transmission between the transmitter 27 and the receiver 31 is radio frequency (RF) transmission by which the transmitter 27 generates a RF signal emitted through the antenna. The receiver 31 is a counterpart RF receiver that receives and RF signal. Another example of the wireless transmission is infrared (IR) transmission by which the control signal is transmitted as an infrared light. In the case of the infrared transmission, no antenna is needed.

The micro-controller 21 is operated on the basis of the clock signal CLK provided by the clock unit 23. The micro-controller 21 periodically issues a synchronization signal to the lamp control module 3, such as every 10 minutes, to maintain synchronization between the remote controlling device 100 and the lamp control module 3. Further, for a LCD based display 15, back lighting is often required. The micro-controller 21 may de-activate the back lighting when the remote controlling device 100 has been in idle condition for a given period of time, such as 30 minutes. This reduces the power consumption of the remote controlling device 100.

Figure 5:
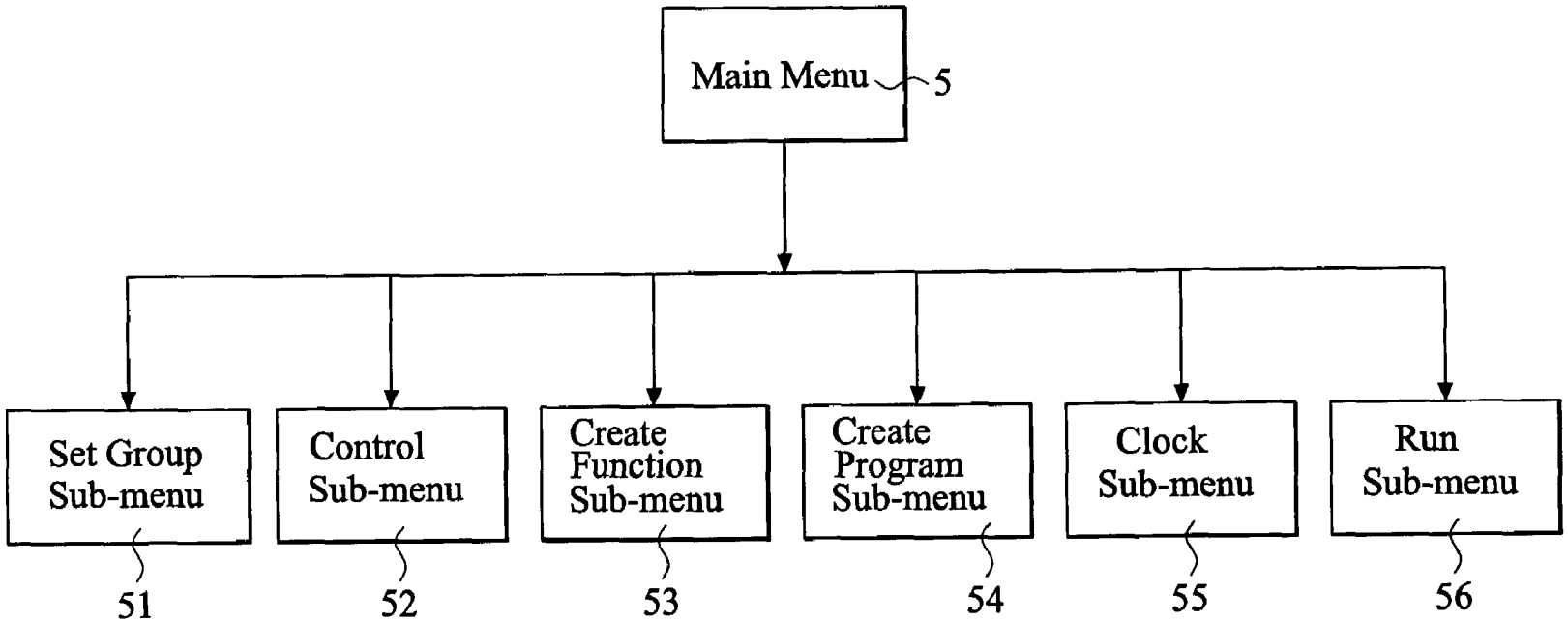
FIG. 5 is a schematic view illustrating a selection menu architecture in accordance with the present invention.
Figure 6:
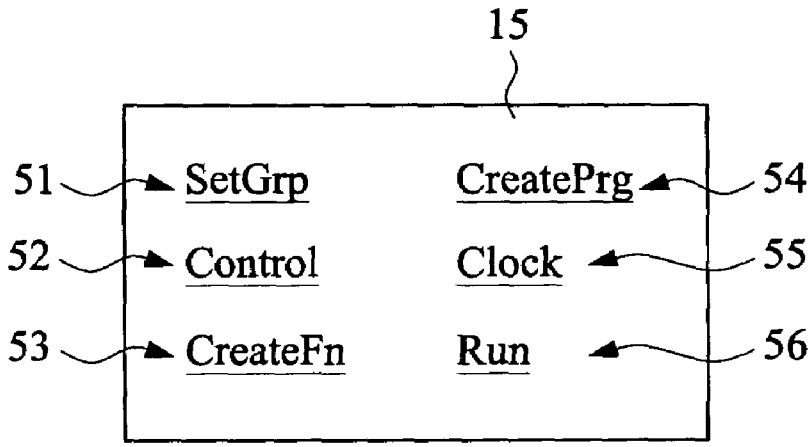
FIG. 6 is a schematic view illustrating the selection menu shown in a display.

The operation menus that are displayed on the display 15 for the selection and access by the user include a main menu and a number of sub-menus. FIG. 5 shows an example of the main menu, which is designated with reference numeral 5. The main menu 5 includes a number of sub-menus, including a "Set Group (SetGrp)" sub-menu 51, a "Control" sub-menu 52, a "Create Function (CreateFn)" sub-menu 53, a "Create Program (CreatePrg)" sub-menu 54, a "Clock" sub-menu 55, and a "Run" sub-menu 56. All these menus, including both the main menu 5 and the sub-menus 51-56, are displayed on the display 15 of which an example is shown in FIG. 6. The user may move the cursor on the display 15 with the aid of the direction switches 141, 142, 143, and 144 of the selection pad 14 to the desired menu or sub-menu and select the menu by actuating the actuation switch 145 to select the menu. Once a menu or sub-menu is selected, items contained in the menu or sub-menu may be further displayed on the display 15 for selection.

Figure 7:
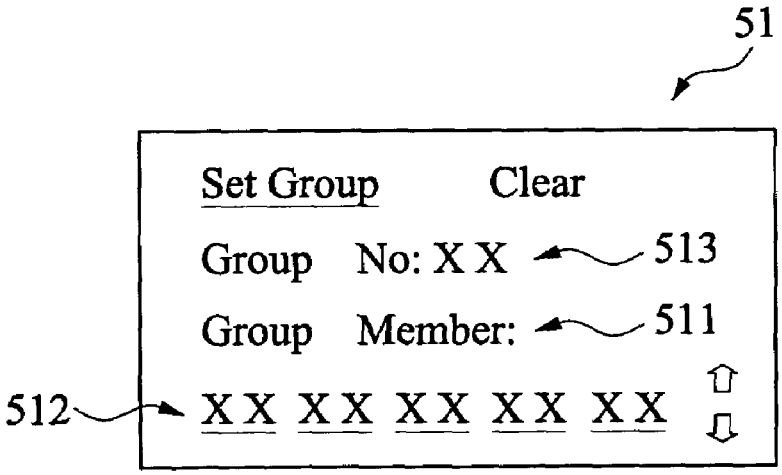
FIG. 7 is a schematic view illustrating an example of a "Set Group" sub-menu in accordance with the present invention.

For example, when the "Set Group" sub-menu 51 is selected, the items contained in the "Set Group" sub-menu 51 is displayed on the display 15 as shown in FIG. 7. These items include "Group Member", which includes the lamp groups available, for example 99 groups of lamps. The user may use the selection pad 14 to select a desired lamp group bearing a group number 513 and add the lamp groups to a list 512. The lamp groups that are available for user's selection are stored in the preset lighting mode memory 24 or the user-defined lighting mode memory 25.

Figure 8:
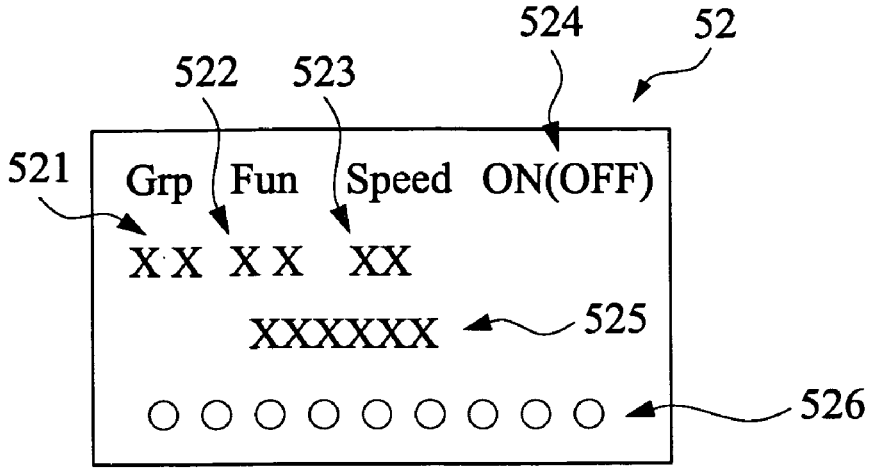
FIG. 8 is a schematic view illustrating an example of a "Control" sub-menu in accordance with the present invention.

FIG. 8 shows an example of the "Control" sub-menu 52, which contains the following items: group number (Grp) 521, function number (Fun) 522, lighting speed (Speed) 523, start/stop operation (ON/OFF) 524, operation mode 525, mode-related mark or pattern 526. The lighting speed 523 allows the user to modify the lighting speed of the lamps of a selected group. The operation mode 525 allows the user to select a desired mode among a plurality of sub-items, which include at least (1) chasing, (2) fading, (3) fading all, (4) all flash, (5) sequence on, (6) step on-off, (7) step fading, (8) morphing, (9) stop morphing, (10) one outlet on, (11) other outlet on, (12) cascading, and (13) steady.

Figure 9:
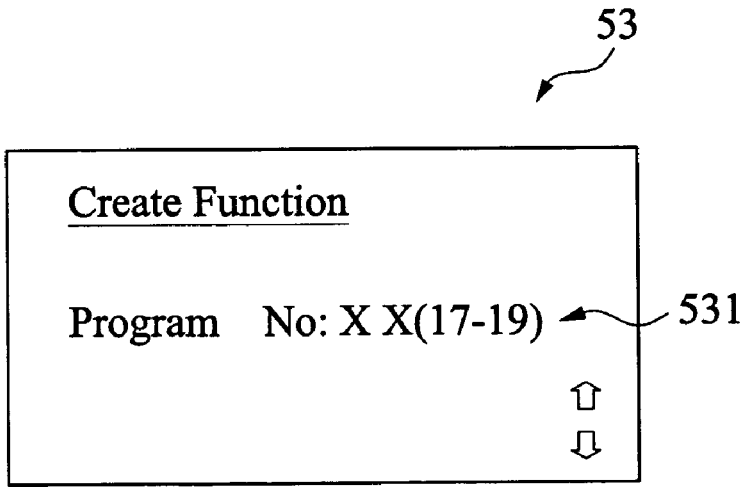
FIG. 9 is a schematic view illustrating an example of a "Create Function" sub-menu in accordance with the present invention.
Figure 9A:
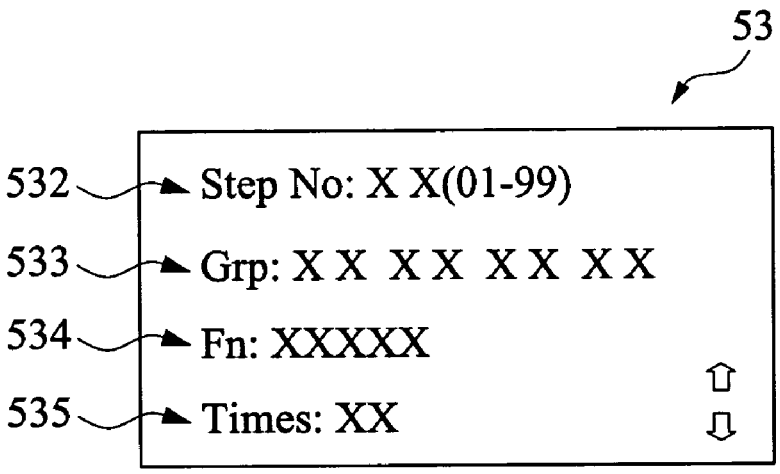
FIG. 9A is a schematic view illustrating a sub-listing of items associated with the "Create Function" sub-menu in accordance with the present invention.

FIG. 9 shows an example of the "Create Function" sub-menu 53, which contains an item of program number, which may include for example of 19 control problems for controlling the lamp string 4. In the embodiment illustrated, program numbers 17 to 19 are user-defined lamp string control programs. When the user enters or selects a desired program number, as shown in FIG. 9A, a sub-list of "step number (Step No.)" 532, "group number (Grp)" 533, "function (Fn)" 534, and "time" 535 is shown in the display. The "step number" item 532 allows for at most 99 steps (01-99), and each step is associated with at most four groups. The "flashing setting" item 534 contains four basic functions, including "ON", "OFF", "FADE ON", "FADE OFF".

Figure 10:
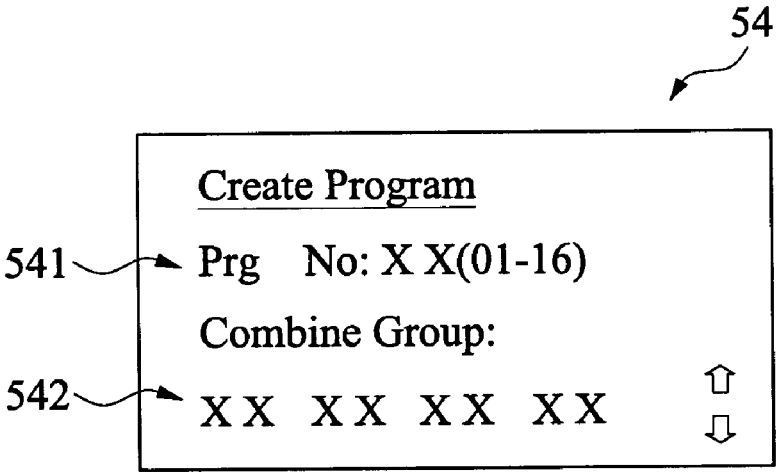
FIG. 10 is a schematic view illustrating an example of a "Create Program" sub-menu in accordance with the present invention.

FIG. 10 shows an example of the "Create Program" sub-menu 54, which contains an item of "program number (Prg No.)" 541 and an item of "combined group (Combine Group)" 542. The difference between the "Create Function" sub-menu 53 and the "Create Program" sub-menu 54 is that the "Create Function" sub-menu 53 controls the functions within groups, while the "Create Program" sub-menu 54 provides a function of combination.

Figure 11:
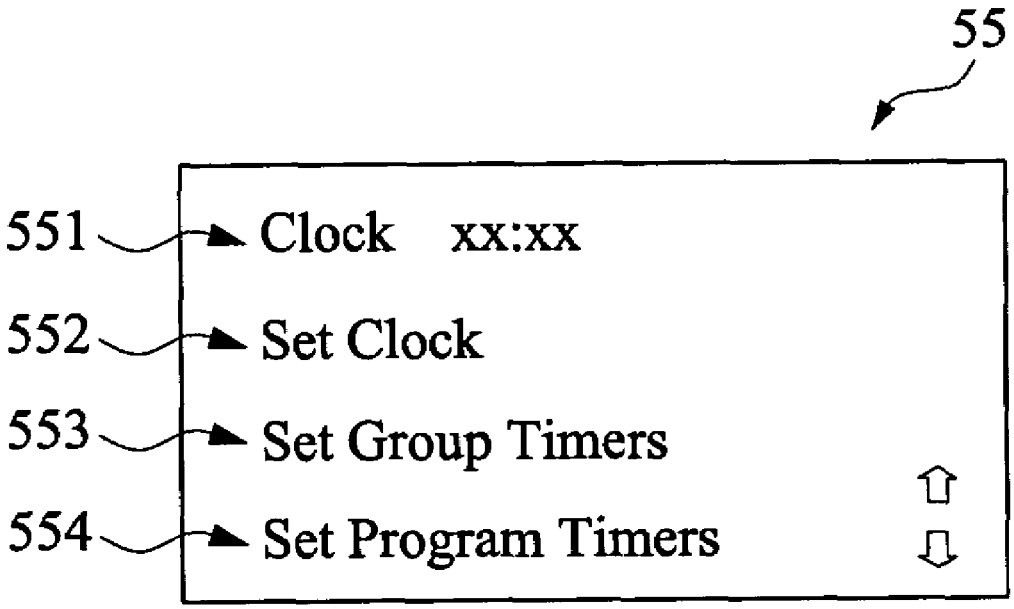
FIG. 11 is a schematic view illustrating an example of a "Clock" sub-menu in accordance with the present invention.

FIG. 11 shows an example of the "Clock" sub-menu 55, which contains "clock" 551, "set clock" 552, "set group timer" 553, and "set program timers" 554. The "set clock" 552 allows the user to set and re-set the system clock. The "set group timer" allows the user to set and re-set the starting time and ending time of lamp lighting, while the "set program timers" 554 allows the user to set timing within a control program.

Although the present invention has been described with reference to the preferred embodiment thereof, it is apparent to those skilled in the art that a variety of modifications and changes may be made without departing from the scope of the present invention intended to be defined by the appended claims.

What is claimed is:

1. A remote controlling device adapted to transmit a control signal that is receivable by a receiver of a lamp control module, the lamp control module being provided with a control unit coupled to a lamp string comprising a plurality of groups of lamps for controlling the lamps upon receiving the control signal, the remote controlling device comprising:

a micro-controller;

a clock unit coupled to the micro-controller for providing the micro-controller with a clock signal;

a transmitter coupled to the micro-controller to selectively transmit the control signal, the transmitter comprising an encoder for coding the control signal;

a preset lighting mode memory coupled to the micro-controller to store preset lighting modes each defining a selective lighting of the lamps within a common lamp group;

a lighting control program memory coupled to the micro-controller to store lighting control programs, each of the lighting control programs selectively combining for a plurality of lamp groups lighting modes selected therefor from the preset lighting mode memory;

selection switches coupled to the micro-controller and accessible by a user to select the preset lighting modes and the lighting control programs; and a transmission button coupled to the micro-controller and actuateable by the user to emit the control signal that carries the lighting control program selected from the lighting control program memory toward the receiver of the lamp control module of the lamp string.

2. The remote controlling device as claimed in claim 1 further comprising a user-defined lighting mode memory that stores at least one user defined lighting mode.

3. The remote controlling device as claimed in claim 1, wherein the micro-controller generates a synchronization signal to the lamp control module of the lamp string at a preset time interval based on the clock signal from the clock unit.

4. The remote controlling device as claimed in claim 1 further comprising a display that is coupled to the micro-controller to display the selection of the lighting mode and the lighting control program by the user.

5. A remote controlling device adapted to transmit a control signal that is receivable by a receiver of a lamp control module, the lamp control module being provided with a lamp string comprising a plurality of groups of lamps for controlling lighting operation of the lamps upon receiving the control signal, the remote controlling device comprising:

a micro-controller;

a clock unit coupled to the micro-controller for providing the micro-controller with a clock signal;

a transmitter coupled to the micro-controller to selectively transmit the control signal, the transmitter comprising an encoder for coding the control signal;

a lighting control program memory coupled to the micro-controller to store lighting control programs, each of the lighting control programs selectively combining for a plurality of lamp groups lighting modes selected therefor from a preset lighting mode memory, each lighting mode defining a selective lighting of the lamps within a common lamp group;

selection switches coupled to the micro-controller and accessible by a user to select the lighting control programs; and a transmission button coupled to the micro-controller and actuateable by the user to emit the control signal that carries the lighting control program selected from the lighting control program memory toward the receiver of the lamp control module of the lamp string.

6. The remote controlling device as claimed in claim 5, wherein the micro-controller generates a synchronization signal to the lamp control module of the lamp string at a preset time interval based on the clock signal from the clock unit.

7. The remote controlling device as claimed in claim 5 further comprising a display that is coupled to the micro-controller to display the selection of the lighting control program by the user.

* * * * *